US007770242B2

(12) United States Patent
Sell

(10) Patent No.: US 7,770,242 B2
(45) Date of Patent: Aug. 10, 2010

(54) COLLAPSIBLE POTTY

(76) Inventor: Timothy L. Sell, 6993 Brook Trout La., Plymouth, MI (US) 48170

( * ) Notice: Subject to any disclaimer, the term of this patent is extended or adjusted under 35 U.S.C. 154(b) by 1049 days.

(21) Appl. No.: 11/493,683

(22) Filed: Jul. 26, 2006

(65) Prior Publication Data

US 2008/0022445 A1 Jan. 31, 2008

(51) Int. Cl.
*A47K 11/06* (2006.01)

(52) U.S. Cl. ..... 4/484; 4/483; 4/902

(58) Field of Classification Search ..... 4/484, 4/483, 902, 239

See application file for complete search history.

(56) References Cited

U.S. PATENT DOCUMENTS

| | | | | |
|---|---|---|---|---|
| 1,182,670 | A * | 5/1916 | Fountain | 4/235 |
| 2,612,210 | A * | 9/1952 | Light | 4/483 |
| 4,807,308 | A | 2/1989 | Person | |
| 5,040,249 | A | 8/1991 | Diaz | |
| 5,048,130 | A | 9/1991 | Brotman | |
| 5,095,556 | A | 3/1992 | Franey | |
| 5,187,819 | A | 2/1993 | Grimes | |
| 5,251,342 | A | 10/1993 | Sansom | |
| 5,309,580 | A | 5/1994 | Amalsad | |
| 5,524,301 | A | 6/1996 | McGuire | |
| 5,647,670 | A * | 7/1997 | Iscovich | 4/484 |
| 6,047,414 | A | 4/2000 | Bailey | |
| 6,081,943 | A | 7/2000 | Garcete | |
| 6,112,339 | A * | 9/2000 | Nichols et al. | 4/484 |
| 6,116,780 | A | 9/2000 | Young | |
| 6,341,386 | B1 | 1/2002 | Phillips | |
| 6,378,142 | B1 | 4/2002 | Gray | |
| 6,427,256 | B1 | 8/2002 | Mullett | |
| 6,546,569 | B2 * | 4/2003 | Figueras | 4/483 |
| 6,647,560 | B1 | 11/2003 | Hingley | |
| 6,889,393 | B1 | 5/2005 | Rinaldo | |
| 6,948,196 | B2 | 9/2005 | Hinton | |
| 6,986,173 | B1 | 1/2006 | Hickey | |
| 7,260,855 | B2 * | 8/2007 | Aycock | 4/484 |
| 2004/0078883 | A1 * | 4/2004 | Ford | 4/483 |
| 2008/0005831 | A1 * | 1/2008 | Seo | 4/484 |

* cited by examiner

*Primary Examiner*—Khoa D Huynh
(74) *Attorney, Agent, or Firm*—Andrew W. Ludy

(57) ABSTRACT

A collapsible potty comprises a one piece, rigid seat with a central hole through it. A pair of opposed tracks on the seat lower surface extend from front to rear. Left and right support panels are pivotally attached, by means of support hinge knuckles, to seat hinge knuckles on the seat left and right ends, respectively. Hinge pins engage hinge holes in the knuckles. The support panels are able to pivot from a folded position adjacent the seat lower surface, to an open position extending downward.

A flexible, sealable waste bag hangs beneath the seat to receive waste. A tray has a plurality of hooks, arrayed around a central hole, that engage holes in the waste bag. The tray slides into the seat tracks to position the tray central hole directly beneath the seat central hole. A zip-lock closure seals the waste bag.

A resilient locking arm on the seat hinge knuckle expands into a notch in the support hinge knuckle when the support panel is rotated into the open position, to hold the support panel open. A pushbutton release member moves the locking arm out of the notch to release the support panel for folding.

8 Claims, 8 Drawing Sheets

COLLAPSIBLE POTTY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of portable toilets, and more particularly to a collapsible toilet with a disposable waste receptacle, for use by children. For families with young children, there are times when the children have to use the potty while traveling. Most of the time, this occurs on long trips, but there are such instances even on short trips around town. The current best option for this situation is to keep a child's training potty in the vehicle at all times. This has two major disadvantages, however. The potty is fairly large, and thus takes up a large amount of space. Furthermore, cleaning the potty after each use is a nuisance, particularly when taking long trips.

Accordingly, there is a need to provide a collapsible potty that can be folded up for storage in a small space for traveling, and can be quickly set up for use.

There is a further need to provide a collapsible potty of the type described and that can also be used at home for training children.

There is a yet further need to provide a collapsible potty of the type described and that has a disposable waste receptacle that can be sealed after use and discarded.

There is a still further need to provide a collapsible potty of the type described and that will not require cleaning after each use.

There is another need to provide a collapsible potty of the type described and that can be manufactured cost-effectively in large quantities of high quality.

BRIEF SUMMARY OF THE INVENTION

In accordance with the present invention, there is provided a collapsible potty comprising a seat extending between opposite front and rear edges and between opposite left and right ends. The seat has opposite upper and lower surfaces, is one piece, and is rigid. The seat has a central hole through it. The seat lower surface has a pair of opposed tracks extending from adjacent the front edge to adjacent the rear edge.

A left support panel is pivotally attached to the seat left end. The left support panel has an upper edge. The left support panel is able to pivot from a folded position adjacent the seat lower surface, to an open position extending downward from the seat, to support the seat left end.

A right support panel is pivotally attached to the seat right end. The right support panel has an upper edge. The right support panel is able to pivot from a folded position adjacent the seat lower surface, to an open position extending downward from the seat, to support the seat right end. The left and right support panels substantially cover the seat lower surface in the folded position.

Pivotal means is provided for pivotal attachment of the left and right support panels to the seat left and right ends, respectively. The pivotal means comprises at least one, and preferably two, left seat hinge knuckles on the seat left end. The left seat hinge knuckles have a left seat hinge hole with a longitudinal, or front to back, axis.

There is at least one, and preferably three, left support hinge knuckles on the upper edge of the left support panel. The left support hinge knuckles have a left support hinge hole with a longitudinal axis. The left support hinge knuckles are juxtaposed with the left seat hinge knuckles. The left seat hinge hole is in alignment with the left support hinge hole. At least one left hinge pin engages the left seat hinge hole and the left support hinge hole.

The pivotal means also includes at least one, and preferably two, right seat hinge knuckles on the seat right end. The right seat hinge knuckles have a right seat hinge hole with a longitudinal axis.

There is at least one, and preferably three, right support hinge knuckles on the upper edge of the right support panel. The right support hinge knuckles have a right support hinge hole with a longitudinal axis. The right support hinge knuckles are juxtaposed with the right seat hinge knuckles. The right seat hinge hole is in alignment with the right support hinge hole. At least one right hinge pin engages the right seat hinge hole and the right support hinge hole.

A waste bag is adapted for hanging beneath the seat to receive waste. The waste bag is flexible and sealable, and has an upper edge. The waste bag has a plurality of holes through the waste bag adjacent the upper edge. Attaching means is provided for releasably attaching the waste bag beneath the seat. The attaching means includes a tray having a central hole through it. The tray has a plurality of hooks arrayed around the central hole and adapted to engage the waste bag holes. The tray is adapted for sliding engagement with the seat tracks so as to position the tray central hole directly beneath the seat central hole. A zip-lock closure is provided adjacent the waste bag upper edge for sealing the waste bag.

Locking means is shown for locking the left and right support panels in the open position, so as to preclude accidental folding of the support panels and consequent injury to the child. The locking means comprises a resilient locking arm attached as a cantilever to the seat hinge knuckle. The locking arm is resiliently compressed and biased into the path of the support hinge knuckle when the left support panel is in the folded position. The support hinge knuckle has a notch adapted to receive the locking arm. The locking arm expands into the notch when the support panel is rotated into the open position, so as to releasably retain the support panel in the open position. A release member is juxtaposed with the notch, and projects outward from the support panel upper edge, forming a release pushbutton. The release member is adapted to move the locking arm out of the notch when the release member is manually displaced, so as to release the support panel for folding. The locking arm, notch, and release member are duplicated on the left and right sides, similar and opposite hand.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
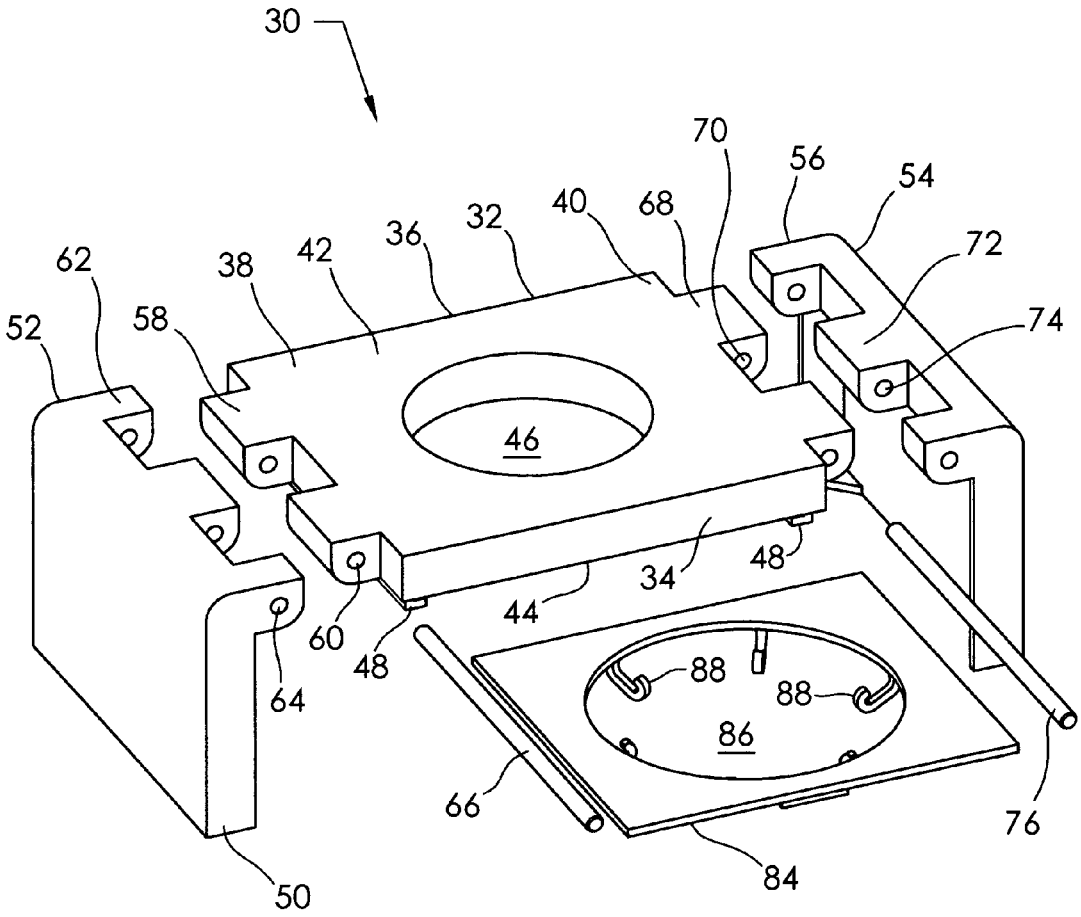
FIG. 1 is an exploded perspective view from above, of a collapsible potty constructed in accordance with the invention.
Figure 2:
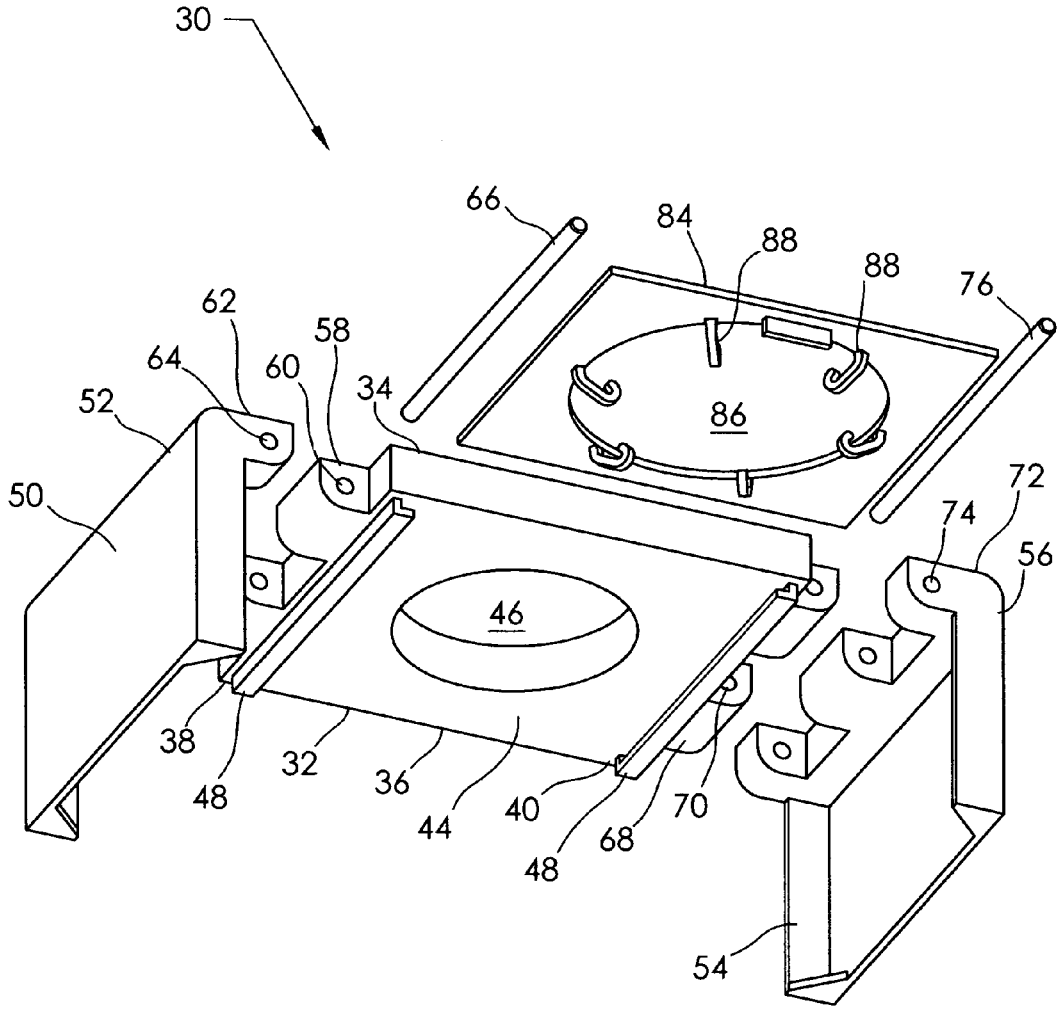
FIG. 2 is an exploded perspective view from below, of the collapsible potty of FIG. 1.

Referring now to the drawing, and especially to FIGS. 1-4, a collapsible potty constructed in accordance with the invention is shown at 30, and comprises a seat 32 extending between opposite front 34 and rear 36 edges and between opposite left 38 and right 40 ends. The seat 32 has opposite upper 42 and lower 44 surfaces, is one piece, and is rigid. The seat 32 has a central hole 46 through it. The seat lower surface 44 has a pair of opposed tracks 48 extending from adjacent the front edge 34 to adjacent the rear edge 36.

Figure 3:
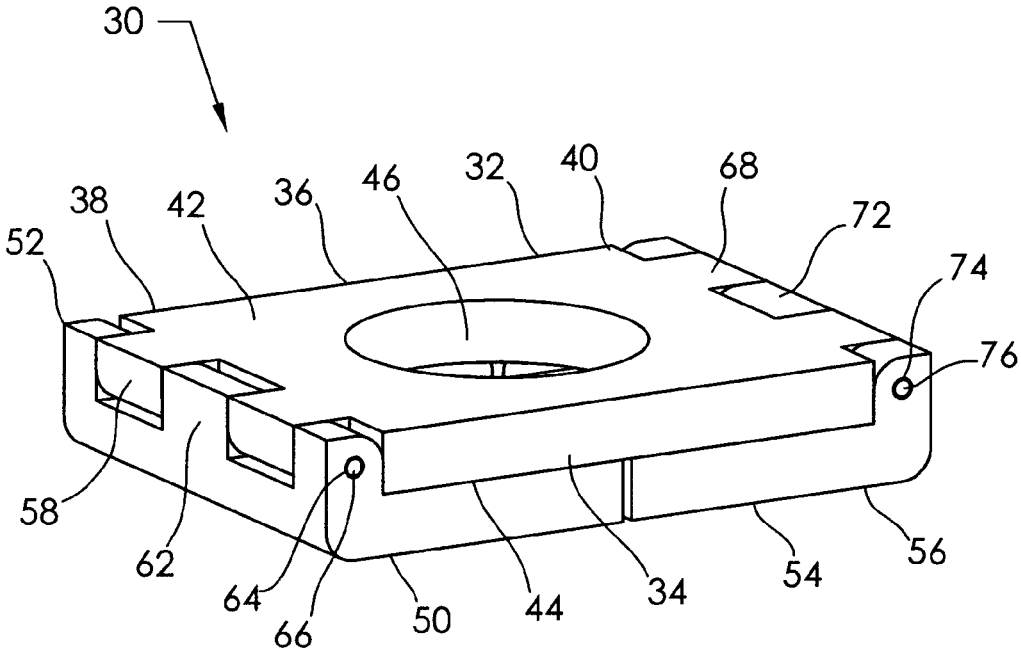
FIG. 3 is a perspective assembly view of the collapsible potty of FIG. 1, shown in a folded or collapsed condition for storage.
Figure 4:
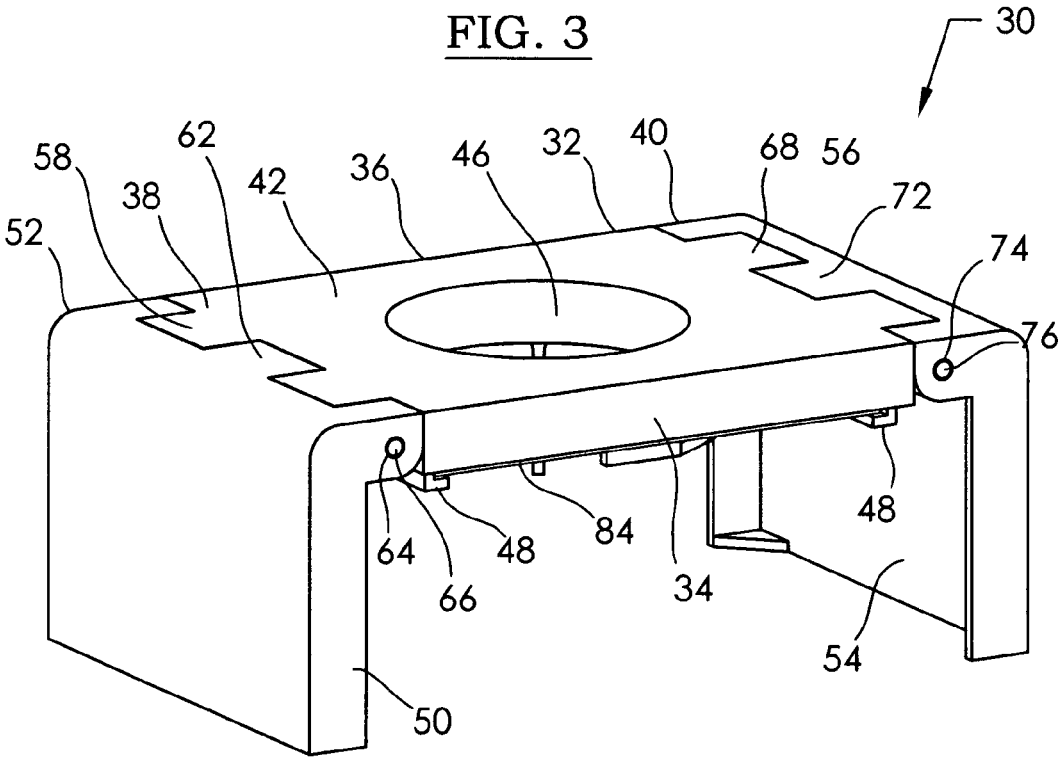
FIG. 4 is a perspective assembly view of the collapsible potty of FIG. 1, shown in an opened condition.
Figure 5:
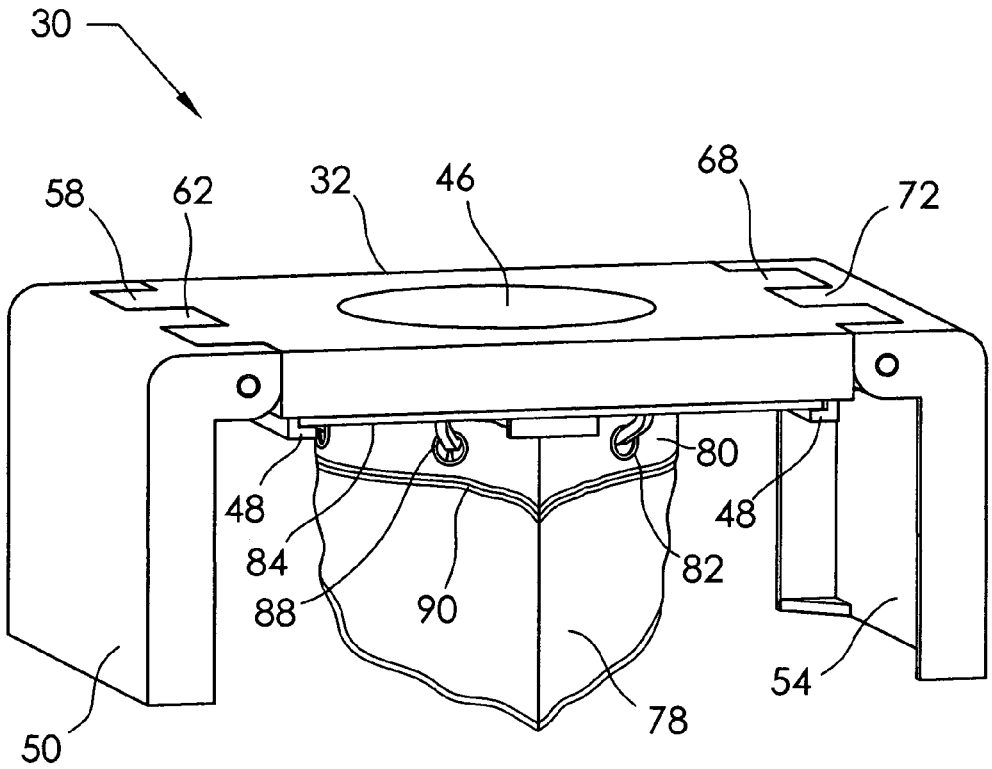
FIG. 5 is a perspective assembly view of the collapsible potty of FIG. 1, shown in an opened condition and ready for use with the disposable waste receptacle installed.
Figure 6:
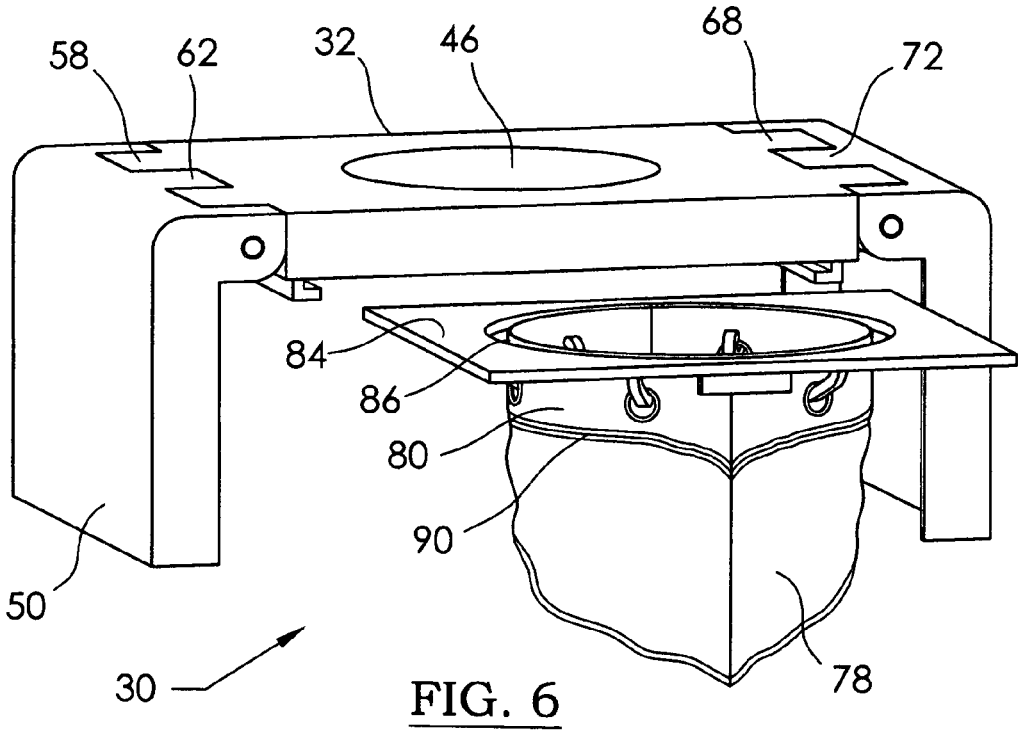
FIG. 6 is a perspective assembly view of the collapsible potty of FIG. 1, shown opened and with the tray holding the disposable waste receptacle removed in preparation for removing, sealing, and discarding the receptacle.
Figure 7:
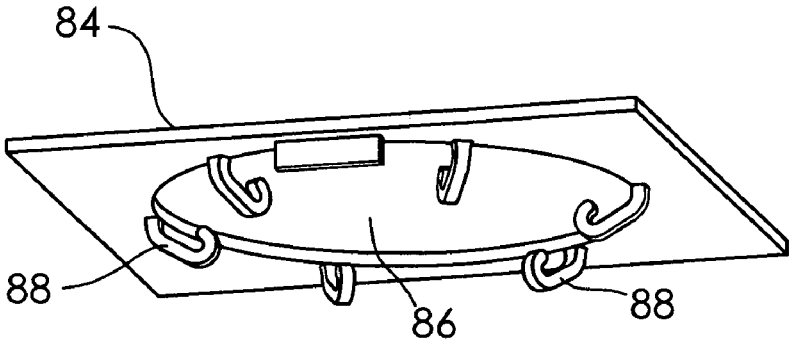
FIG. 7 is a perspective view from below of a tray for holding the disposable waste receptacle of the collapsible potty of FIG. 1.
Figure 8:
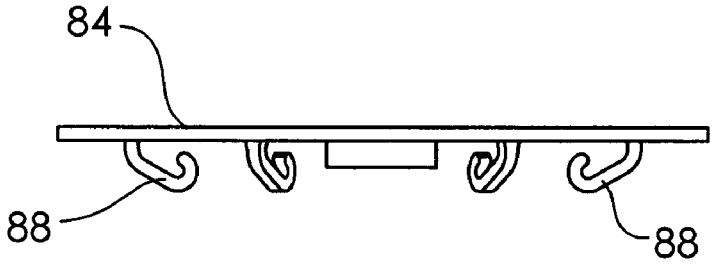
FIG. 8 is a front view of the tray of FIG. 7.
Figure 9:
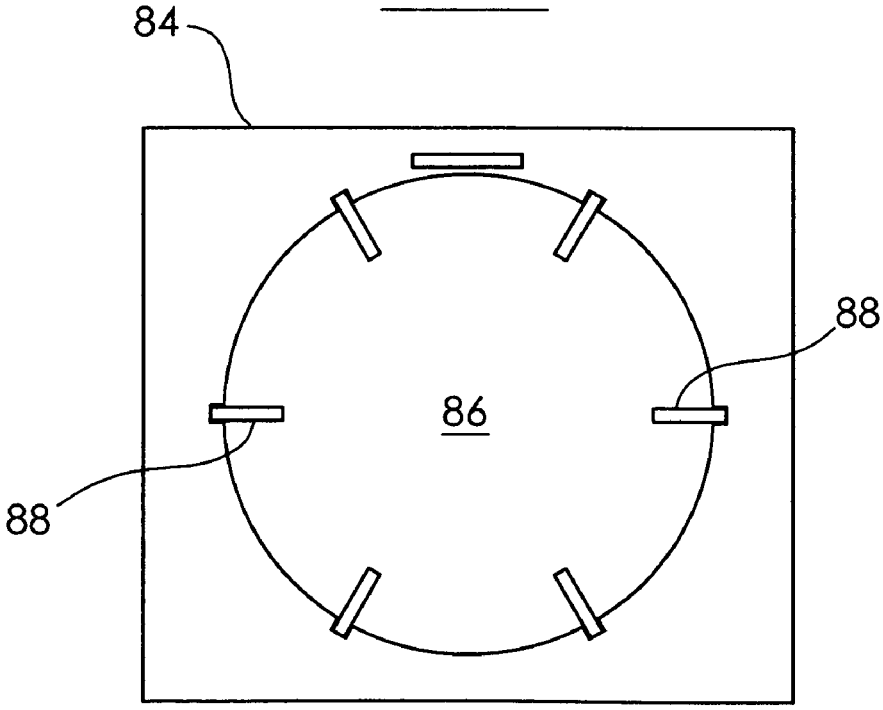
FIG. 9 is a bottom view of the tray of FIG. 7
Figure 10:
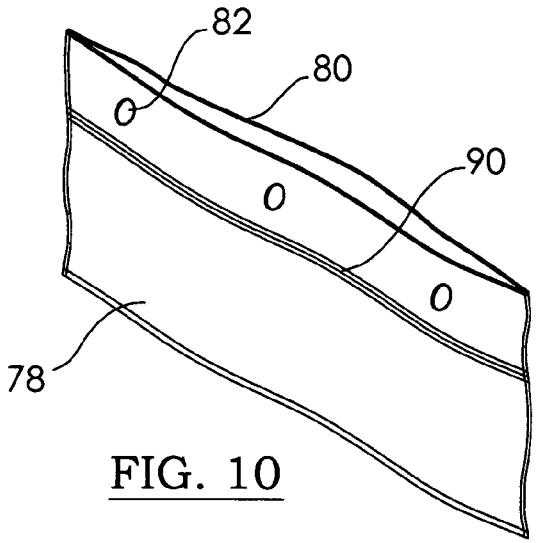
FIG. 10 is a perspective view of the disposable waste receptacle of the collapsible potty of FIG. 1, shown in a folded condition.
Figure 13:
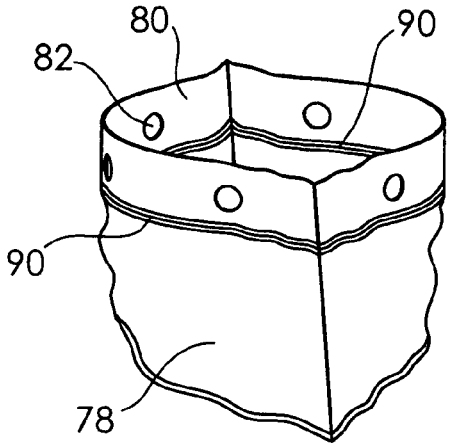
FIG. 13 is another perspective view of the disposable waste receptacle of FIG. 10, shown in an opened condition.
Figure 11:
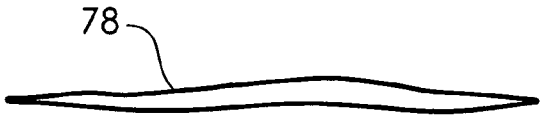
FIG. 11 is a top view of the disposable waste receptacle of FIG. 10.
Figure 14:
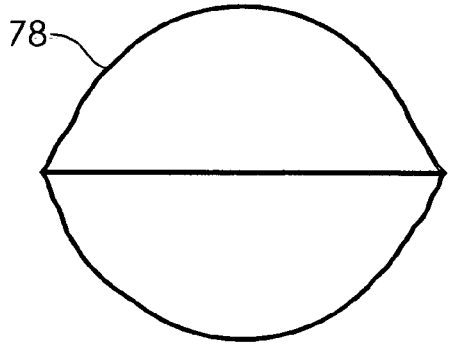
FIG. 14 is a top view of the disposable waste receptacle of FIG. 10, shown in an opened condition.
Figure 12:
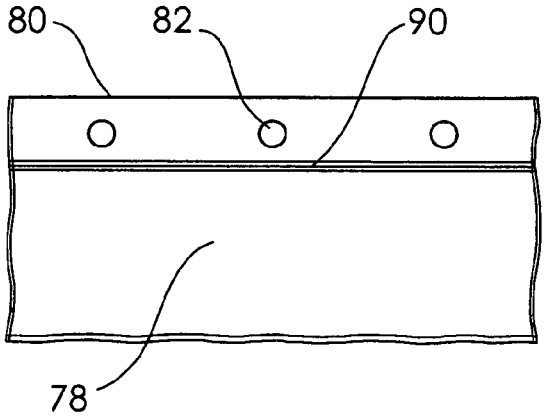
FIG. 12 is a front elevational view of the disposable waste receptacle of FIG. 10.
Figure 15:
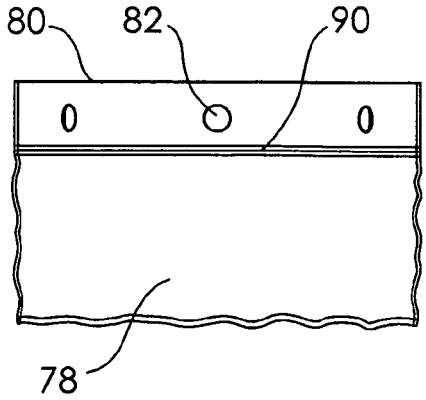
FIG. 15 is a front elevational view of the disposable waste receptacle of FIG. 10, shown in an opened condition.

A left support panel 50 is pivotally attached to the seat left end 38. The left support panel 50 has an upper edge 52. The left support panel 50 is able to pivot from a folded position adjacent the seat lower surface 44, as shown in FIG. 3, to an open position extending downward from the seat 32, as shown in FIG. 4, so as to support the seat left end 38.

A right support panel 54 is pivotally attached to the seat right end 40. The right support panel 54 has an upper edge 56. The right support panel 54 is able to pivot from a folded position adjacent the seat lower surface 44, as shown in FIG. 3, to an open position extending downward from the seat 32, as shown in FIG. 4, so as to support the seat right end 40. The left 50 and right 54 support panels substantially cover the seat lower surface 44 in the folded position.

Pivotal means is provided for pivotal attachment of the left 50 and right 54 support panels to the seat left 38 and right 40 ends, respectively. Specifically, the pivotal means comprises at least one, and preferably two, left seat hinge knuckles 58 on the seat left end 38. The left seat hinge knuckles 58 have a left seat hinge hole 60 with a longitudinal, or front to back, axis.

There is at least one, and preferably three, left support hinge knuckles 62 on the upper edge 52 of the left support panel 50. The left support hinge knuckles 62 have a left support hinge hole 64 with a longitudinal axis. The left support hinge knuckles 62 are juxtaposed with the left seat hinge knuckles 58. The left seat hinge hole 60 is in alignment with the left support hinge hole 64. At least one left hinge pin 66 engages the left seat hinge hole 60 and the left support hinge hole 64.

The pivotal means also includes at least one, and preferably two, right seat hinge knuckles 68 on the seat right end 40. The right seat hinge knuckles 68 have a right seat hinge hole 70 with a longitudinal axis.

There is at least one, and preferably three, right support hinge knuckles 72 on the upper edge 56 of the right support panel 54. The right support hinge knuckles 72 have a right support hinge hole 74 with a longitudinal axis. The right support hinge knuckles 72 are juxtaposed with the right seat hinge knuckles 68. The right seat hinge hole 70 is in alignment with the right support hinge hole 74. At least one right hinge pin 76 engages the right seat hinge hole 70 and the right support hinge hole 74.

Turning now to FIGS. 5-15, as well as 1-4, a waste bag 78 is adapted for hanging beneath the seat 32 to receive waste. The waste bag 78 is flexible and sealable, and has an upper edge 80. The waste bag 78 has a plurality of holes 82 through the waste bag 78 adjacent the upper edge 80. Attaching means is provided for releasably attaching the waste bag 78 beneath the seat 32. The attaching means includes a tray 84 having a top surface, a bottom surface a central hole 86 through it. The tray 84 has a plurality of inward-facing hooks 88 arrayed around the central hole 86 and adapted to engage the waste bag holes 82. The tray 84 is adapted for sliding engagement with the seat tracks 48 so as to position the tray central hole 86 directly beneath the seat central hole 46. Sealing means is provided for sealing the waste bag 78. The sealing means comprises a zip-lock closure 90 adjacent the waste bag upper edge 80. Another sealing means comprises an adhesive strip 90 adjacent the waste bag upper edge 80. The left 50 and right 54 support panels cover the waste bag 78 in the folded position. The potty is ready to use when the panels are opened.

Figure 16:
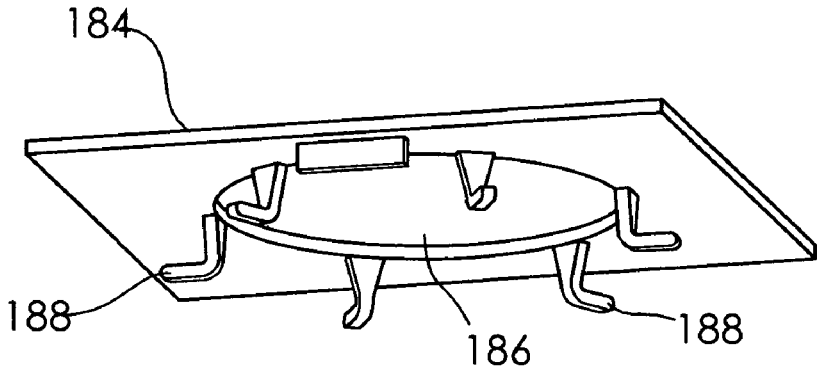
FIG. 16 is a perspective view from below of another tray for holding the disposable waste receptacle of the collapsible potty of FIG. 1.
Figure 17:
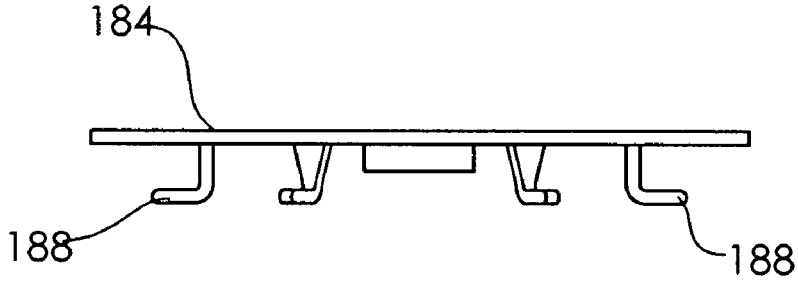
FIG. 17 is a front view of the tray of FIG. 16.
Figure 18:
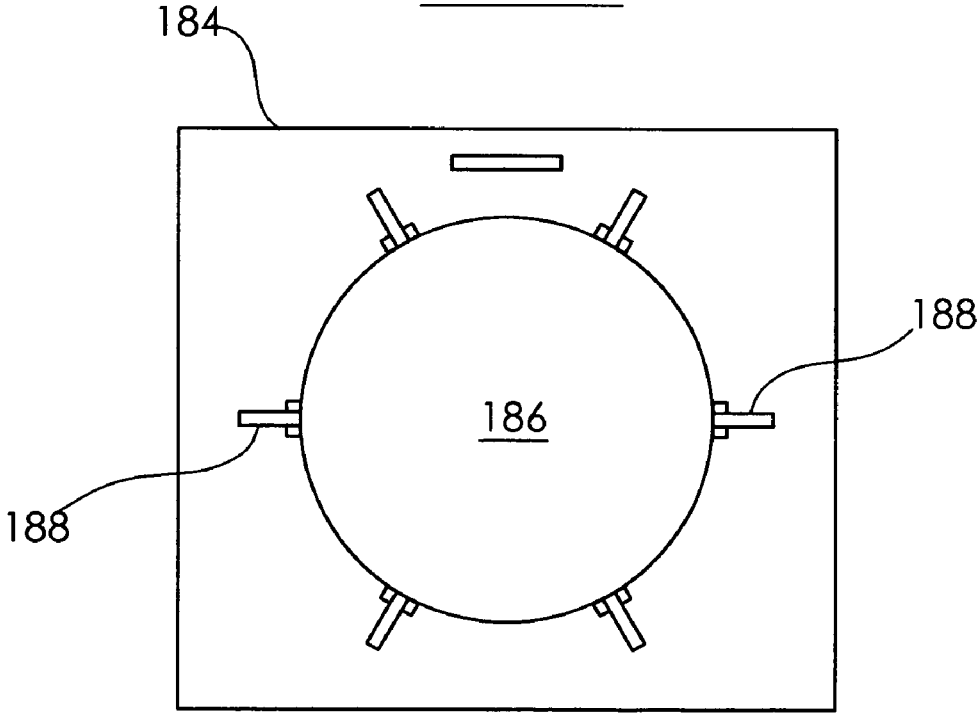
FIG. 18 is a bottom view of the tray of FIG. 16.
Figure 19:
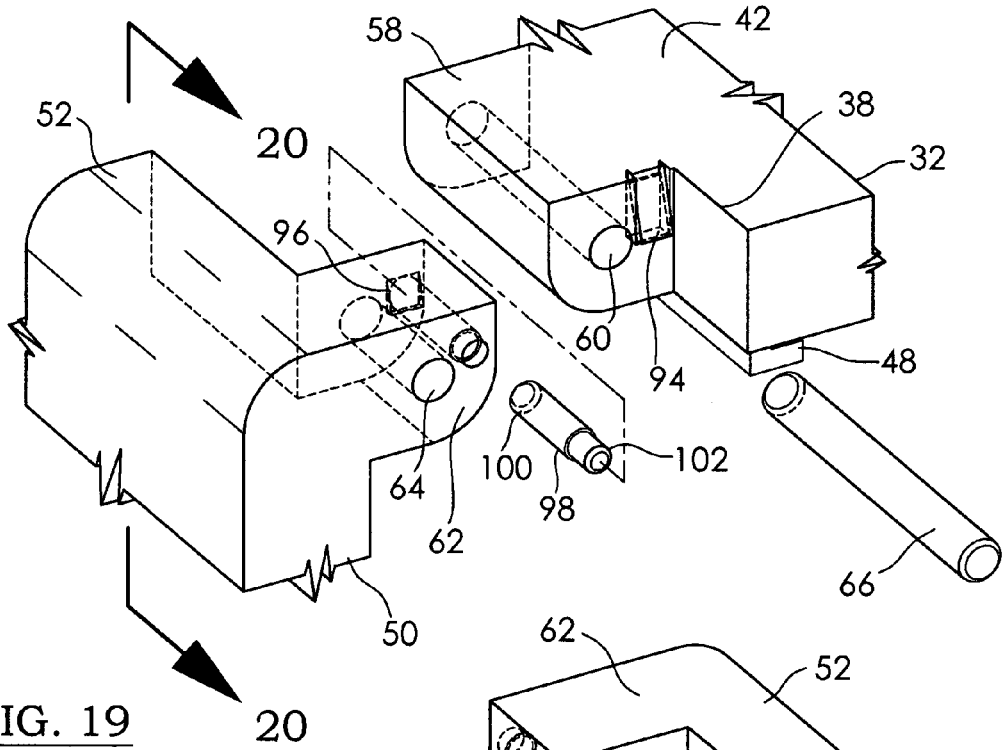
FIG. 19 is a partial perspective view of a locking means for use with the collapsible potty of FIG. 1, viewed from the front.
Figure 20:
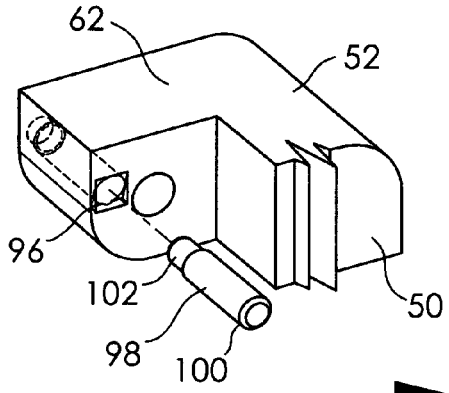
FIG. 20 is another partial perspective view of the locking means of FIG. 19, taken along lines 20-20 of FIG. 19.
Figure 22:
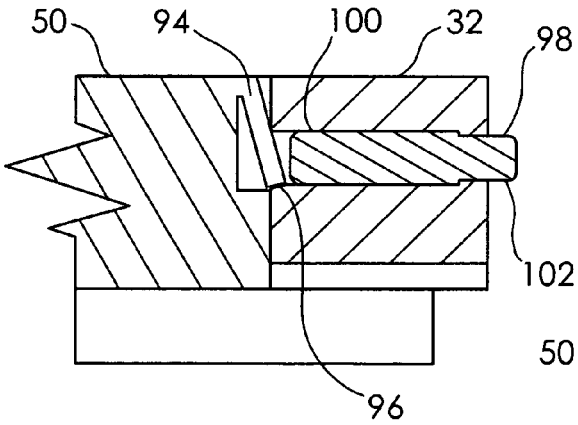
FIG. 22 is a partial sectional side elevational view of the collapsible potty of FIG. 1 with the locking means of FIG. 19, taken along lines 22-22 of FIG. 21.
Figure 21:
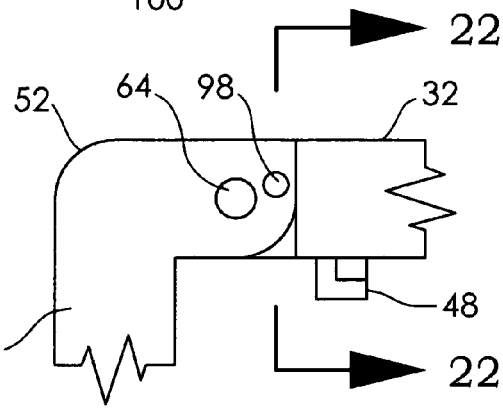
FIG. 21 is a partial front elevational view of the collapsible potty of FIG. 1 with the locking means of FIG. 19.

Referring now to FIGS. 16-18, another tray 184 is similar to tray 84 described above, in that tray 184 has a central hole 186 through it. The tray 184 has a plurality of hooks 188 arrayed around the central hole 186 and adapted to engage the waste bag holes 82. The tray 184 is adapted for sliding engagement with the seat tracks 48 so as to position the tray central hole 186 directly beneath the seat central hole 46. The tray 184 differs from tray 84 in that the hooks 188 face outward.

Referring now to FIGS. 19-22, optional locking means is shown for locking the left 50 and right 54 support panels in the open position, so as to preclude accidental folding of the left 50 and right 54 support panels and consequent injury to the child. The locking means comprises a left locking arm 94. The left locking arm 94 is resilient and is attached as a cantilever to one of either the seat left end 38 or the left support panel 50. The left locking arm 94 is resiliently compressed and biased into the path of the opposing one of either the seat left end 38 or the left support panel 50 when the left support panel 50 is in the folded position. The opposing one of either the seat left end 38 or the left support panel 50 has a left notch 96 adapted to receive the left locking arm 94. In the preferred embodiment shown in FIG. 19, the left locking arm 94 is attached to the left seat hinge knuckle 58. Opposite this is the left support hinge knuckle 62, which has the left notch 96. The left locking arm 94 expands into the left notch 96 when the left support panel 50 is rotated into the open position, so as to releasably retain the left support panel 50 in the open position. A left release member 98, in this example a shaft, has a proximal end 100 juxtaposed with the left notch 96. The opposite distal end 102 projects outward from the left support panel upper edge 52, forming a release pushbutton. The left release member 98 is adapted to move the left locking arm 94 out of the left notch 96 when the left release member 98 is manually displaced, so as to release the left support panel 50 for folding.

The locking means also comprises a right locking arm. Although not shown, the right locking arm is similar and opposite hand to the left locking arm 94. The right locking arm is resilient and attached as a cantilever to one of either the seat right end or the right support panel. The right locking arm is resiliently compressed and biased into the path of the opposing one of either the seat right end or the right support panel when the right support panel is in the folded position. The opposing one of either the seat right end or the right support panel has a right notch (not shown) adapted to receive the right locking arm. The right notch is similar to the left notch 96 described above. The right locking arm expands into the right notch when the right support panel is rotated into the open position so as to releasably retain the right support panel in the open position. A right release member (not shown), similar to the left release member 98, is juxtaposed with the right notch, to release the right support panel for folding.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST
COLLAPSIBLE POTTY

| PART NO. | DESCRIPTION |
|---|---|
| 30 | collapsible potty |
| 32 | seat |
| 34 | front edge |
| 36 | rear edge |
| 38 | left end |
| 40 | right end |
| 42 | upper surface |
| 44 | lower surface |
| 46 | central hole |
| 48 | tracks |
| 50 | left support panel |
| 52 | left support panel upper edge |
| 54 | right support panel |
| 56 | right support panel upper edge |
| 58 | left seat hinge knuckles |

-continued

PARTS LIST
COLLAPSIBLE POTTY

| PART NO. | DESCRIPTION |
|---|---|
| 60 | left seat hinge hole |
| 62 | left support hinge knuckles |
| 64 | left support hinge hole |
| 66 | left hinge pin |
| 68 | right seat hinge knuckles |
| 70 | right seat hinge hole |
| 72 | right support hinge knuckles |
| 74 | right support hinge hole |
| 76 | right hinge pin |
| 78 | waste bag |
| 80 | waste bag upper edge |
| 82 | waste bag holes |
| 84 | tray |
| 86 | tray central hole |
| 88 | hooks |
| 90 | zip-lock closure |
| 90 | adhesive strip |
| 94 | left locking arm |
| 96 | left notch |
| 98 | left release member |
| 100 | proximal end |
| 102 | distal end |
| 184 | tray |
| 186 | tray central hole |
| 188 | hooks |

The embodiments of the invention in which an exclusive property or privilege is claimed are defined as follows:

1. A portable, collapsible potty comprising:

a seat extending between opposite front and rear edges and between opposite left and right ends, the seat having opposite upper and lower surfaces, the seat being one piece and rigid, the seat having a central hole therethrough, the seat lower surface having a pair of opposed tracks forming on the left and right ends of the seat and extending from adjacent the front edge to adjacent the rear edge;

a left support panel pivotally attached to the seat left end, the left support panel having an upper edge, the left support panel is pivoted from a folded position in which the left support panel extending horizontally adjacent to and substantially parallel to the seat lower surface, to an open position in which the left support panel extending vertically downward and substantially perpendicular to the seat lower surface, so as to form a leg for supporting the seat left end;

a right support panel pivotally attached to the seat right end, the right support panel having an upper edge, the right support panel is pivoted from a folded position in which the right support panel extending horizontally adjacent to and substantially parallel to the seat lower surface, to an open position in which the right support panel extending vertically downward and substantially perpendicular to the seat lower surface, so as to form a leg for supporting the seat right end, wherein the left and right support panels substantially covering the seat lower surface in the folded position;

a plurality of left seat hinge knuckles on the seat left end, each of the left seat hinge knuckles having a left seat hinge hole with a longitudinal axis;

a plurality of left support hinge knuckles on the upper edge of the left support panel, each of the left support hinge knuckles having a left support hinge hole with a longitudinal axis, the left support hinge knuckles being juxtaposed with the left seat hinge knuckles, with the left seat hinge hole being in alignment with the left support hinge hole;

at least one left hinge pin engaging the left seat hinge hole and the left support hinge hole;

a plurality of right seat hinge knuckles on the seat right end, each of the right seat hinge knuckles having a right seat hinge hole with a longitudinal axis;

a plurality of right support hinge knuckles on the upper edge of the right support panel, each of the right support hinge knuckles having a right support hinge hole with a longitudinal axis, the right support hinge knuckles being juxtaposed with the right seat hinge knuckles, with the right seat hinge hole being in alignment with the fight support hinge hole;

at least one fight hinge pin engaging the right seat hinge hole and the right support hinge hole;

a waste bag hanging beneath the seat to receive waste, the waste bag being flexible and sealable, the waste bag having an upper edge, the waste bag having a plurality of holes through the waste bag adjacent the upper edge;

a tray having a top surface, a bottom surface and a central hole therethrough, the tray having a plurality of hooks formed on the bottom surface of the tray and arrayed around the central hole, the hooks removably engage the waste bag holes so as to suspend the waste bag beneath the seat to receive waste, the tray is sliding engaged with the seat opposing tracks so as to dispose the tray central hole directly beneath the seat central hole;

sealing means for sealing the waste bag; and locking means for locking the left and right support panels in the open position, so as to preclude accidental folding of the left and right support panels and consequent injury, wherein the locking means comprises a left locking arm being resilient and attached as a cantilever to one of the seat left end and the left support panel, a left notch that receives the left locking arm, a right locking arm being resilient and attached as a cantilever to one of the seat right end and the right support panel and a right notch that receives the right locking arm.

2. The collapsible potty of claim 1, wherein the tray further comprises a lower surface, the hooks are disposed on the lower surface, and the hooks face inward.

3. The collapsible potty of claim 1, wherein the tray further comprises a lower surface, the hooks are disposed on the lower surface, and the hooks face outward.

4. The collapsible potty of claim 1, wherein the sealing means further comprises a zip-lock closure adjacent the waste bag upper edge.

5. The collapsible potty of claim 1, wherein the sealing means further comprises an adhesive strip adjacent the waste bag upper edge.

6. The collapsible potty of claim 1, wherein the sealing means further comprises a zip-lock closure adjacent the waste bag upper edge.

7. The collapsible potty of claim 1, wherein the sealing means further comprises an adhesive strip adjacent the waste bag upper edge.

8. The collapsible potty of claim 1, wherein the locking means further comprises:

the left locking arm being resiliently compressed and biased into the path of the opposing one of the seat left end and the left support panel when the left support panel is in the folded position, the opposing one of the seat left end and the left support panel having the left notch which receives the left locking arm, the left locking arm expanding into the left notch when the left support panel is rotated into the open position so as to releasably retain the left support panel in the open position;

a left release member juxtaposed with the left notch, the left release member being adapted to move the left locking arm out of the left notch when the left release member is manually displaced, so as to release the left support panel for folding;

the right locking arm being resiliently compressed and biased into the path of the opposing one of the seat right end and the right support panel when the right support panel is in the folded position, the opposing one of the seat right end and the right support panel having the right notch which receives the right locking arm, the right locking arm expanding into the right notch when the right support panel is rotated into the open position so as to releasably retain the right support panel in the open position; and a right release member juxtaposed with the right notch, the right release member being adapted to move the right locking arm out of the right notch when the right release member is manually displaced, so as to release the right support panel for folding.

* * * * *